US006211758B1

(12) United States Patent
Castonguay et al.

(10) Patent No.: US 6,211,758 B1
(45) Date of Patent: Apr. 3, 2001

(54) CIRCUIT BREAKER ACCESSORY GAP CONTROL MECHANISM

(75) Inventors: Roger N. Castonguay, Terryville; James L. Rosen, West Hartford, both of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/481,022

(22) Filed: Jan. 11, 2000

(51) Int. Cl.[7] ..... H01H 9/02
(52) U.S. Cl. ..... 335/202; 335/132
(58) Field of Search ..... 335/6, 14, 20, 335/35, 166–176, 202; 200/293–308

(56) References Cited

U.S. PATENT DOCUMENTS

| | | |
|---|---|---|
| D. 367,265 | 2/1996 | Yamagata et al. . |
| 2,340,682 | 2/1944 | Powell . |
| 2,719,203 | 9/1955 | Gelzheiser et al. . |
| 2,937,254 | 5/1960 | Ericson . |
| 3,158,717 | 11/1964 | Jencks et al. . |
| 3,162,739 | 12/1964 | Klein et al. . |
| 3,197,582 | 7/1965 | Norden . |
| 3,307,002 | 2/1967 | Cooper . |
| 3,517,356 | 6/1970 | Hanafusa . |
| 3,631,369 | 12/1971 | Menocal . |
| 3,803,455 | 4/1974 | Willard . |
| 3,883,781 | 5/1975 | Cotton . |
| 4,129,762 | 12/1978 | Bruchet . |
| 4,144,513 | 3/1979 | Shafer et al. . |
| 4,158,119 | 6/1979 | Krakik . |
| 4,165,453 | 8/1979 | Hennemann . |
| 4,166,988 | 9/1979 | Ciarcia et al. . |
| 4,220,934 | 9/1980 | Wafer et al. . |
| 4,255,732 | 3/1981 | Wafer et al. . |
| 4,259,651 | 3/1981 | Yamat . |
| 4,263,492 | 4/1981 | Maier et al. . |
| 4,276,527 | 6/1981 | Gerbert-Gaillard et al. . |
| 4,297,663 | 10/1981 | Seymour et al. . |
| 4,301,342 | 11/1981 | Castonguay et al. . |
| 4,360,852 | 11/1982 | Gilmore . |
| 4,368,444 | 1/1983 | Preuss et al. . |

(List continued on next page.)

FOREIGN PATENT DOCUMENTS

| | | |
|---|---|---|
| 819 008 | 12/1974 | (BE) . |
| 897 691 | 9/1984 | (BE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 8/1982 | (EP) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |

(List continued on next page.)

*Primary Examiner*—Lincoln Donovan
(74) *Attorney, Agent, or Firm*—Cantor Colburn LLP; Carl B. Horton

(57) ABSTRACT

An accessory for use within a circuit breaker is provided. The accessory includes an actuator having a movable member, a trip member and a link between the movable member and the trip member. The trip member is configured by including a seat portion that allows for a set gap between the link and the movable member.

17 Claims, 9 Drawing Sheets

U.S. PATENT DOCUMENTS 4,375,021 2/1983 Pardini et al. .
4,375,022 2/1983 Daussin et al. .
4,376,270 3/1983 Staffen .
4,383,146 5/1983 Bur .
4,392,036 7/1983 Troebel et al. .
4,393,283 7/1983 Masuda .
4,401,872 8/1983 Boichot-Castagne et al. .
4,409,573 10/1983 DiMarco et al. .
4,435,690 3/1984 Link et al. .
4,467,297 8/1984 Boichot-Castagne et al. .
4,468,645 8/1984 Gerbert-Gaillard et al. .
4,470,027 9/1984 Link et al. .
4,479,143 10/1984 Watanabe et al. .
4,488,133 12/1984 McClellan et al. .
4,492,941 1/1985 Nagel .
4,541,032 9/1985 Schwab .
4,546,224 10/1985 Mostosi .
4,550,360 10/1985 Dougherty .
4,562,419 12/1985 Preuss et al. .
4,589,052 5/1986 Dougherty .
4,595,812 6/1986 Tamaru et al. .
4,611,187 9/1986 Banfi .
4,612,430 9/1986 Sloan et al. .
4,616,198 10/1986 Pardini .
4,622,444 11/1986 Kandatsu et al. .
4,631,625 12/1986 Alexander et al. .
4,642,431 2/1987 Tedesco et al. .
4,644,438 2/1987 Puccinelli et al. .
4,649,247 3/1987 Preuss et al. .
4,658,322 4/1987 Rivera .
4,672,501 6/1987 Bilac et al. .
4,675,481 6/1987 Markowski et al. .
4,682,264 7/1987 Demeyer .
4,689,712 8/1987 Demeyer .
4,694,373 9/1987 Demeyer .
4,710,845 12/1987 Demeyer .
4,717,985 1/1988 Demeyer .
4,733,211 3/1988 Castonguay et al. .
4,733,321 3/1988 Lindeperg .
4,764,650 8/1988 Bur et al. .
4,768,007 8/1988 Mertz et al. .
4,780,786 10/1988 Weynachter et al. .
4,801,907 * 1/1989 Kelaita, Jr. et al. ..... 335/20
4,806,893 * 2/1989 Castonguay et al. ..... 335/20
4,831,221 5/1989 Yu et al. .
4,870,531 9/1989 Danek .
4,883,931 11/1989 Batteux et al. .
4,884,047 11/1989 Baginski et al. .
4,884,164 11/1989 Dziura et al. .
4,900,882 2/1990 Benhard et al. .
4,910,485 3/1990 Bolongeat-Mobleu et al. .
4,914,541 4/1990 Tripodi et al. .
4,916,420 4/1990 Bartolo et al. .
4,916,421 4/1990 Pardini et al. .
4,926,282 5/1990 McGhie .
4,935,590 6/1990 Malkin et al. .
4,937,706 6/1990 Schueller et al. .
4,939,492 7/1990 Raso et al. .
4,943,691 7/1990 Mertz et al. .
4,943,888 7/1990 Jacob et al. .
4,950,855 8/1990 Belonegeat-Mobleu et al. .
4,951,019 8/1990 Gula .
4,952,897 8/1990 Barnel et al. .
4,958,135 9/1990 Baginski et al. .
4,965,543 10/1990 Batteux .
4,983,788 1/1991 Pardini .
5,001,313 3/1991 Leclerq et al. .
5,004,878 4/1991 Seymour et al. .
5,027,093 * 6/1991 Palmer et al. ..... 335/176
5,029,301 7/1991 Nebon et al. .
5,030,804 7/1991 Abri .
5,057,655 10/1991 Kersusan et al. .
5,077,627 12/1991 Fraisse .
5,083,081 1/1992 Barrault et al. .
5,093,643 * 3/1992 Altenhof, Jr. et al. ..... 335/20
5,095,183 3/1992 Raphard et al. .
5,103,198 4/1992 Morel et al. .
5,115,371 5/1992 Tripodi .
5,120,921 6/1992 DiMarco et al. .
5,132,865 7/1992 Mertz et al. .
5,138,121 8/1992 Streich et al. .
5,140,115 8/1992 Morris .
5,153,802 10/1992 Mertz et al. .
5,155,315 10/1992 Malkin et al. .
5,166,483 11/1992 Kersusan et al. .
5,172,087 12/1992 Castonguay et al. .
5,178,504 1/1993 Falchi .
5,184,717 2/1993 Chou .
5,187,339 2/1993 Lissandrin .
5,198,956 3/1993 Dvorak .
5,200,724 4/1993 Gula et al. .
5,210,385 5/1993 Morel et al. .
5,239,150 8/1993 Bolongeat-Mobleu et al. .
5,260,533 11/1993 Livesey et al. .
5,262,744 11/1993 Arnold et al. .
5,280,144 1/1994 Bolongeat-Mobleu et al. .
5,281,776 1/1994 Morel et al. .
5,296,660 3/1994 Morel et al. .
5,296,664 3/1994 Crookston et al. .
5,298,874 3/1994 Morel et al. .
5,300,907 4/1994 Nereau et al. .
5,310,971 5/1994 Vial et al. .
5,313,180 5/1994 Vial et al. .
5,317,471 5/1994 Izoard et al. .
5,331,500 7/1994 Corcoles et al. .
5,334,808 8/1994 Bur et al. .
5,341,191 8/1994 Crookston et al. .
5,343,179 * 8/1994 Pipich et al. ..... 335/167
5,347,096 9/1994 Bolongeat-Mobleu et al. .
5,347,097 9/1994 Bolongeat-Mobleu et al. .
5,350,892 9/1994 Rozier .
5,357,066 10/1994 Morel et al. .
5,357,068 10/1994 Rozier .
5,357,394 10/1994 Piney .
5,361,052 11/1994 Ferullo et al. .
5,373,130 12/1994 Barrault et al. .
5,379,013 1/1995 Coudert .
5,424,701 6/1995 Castonguary et al. .
5,438,176 8/1995 Bonnardel et al. .
5,440,088 8/1995 Coudert et al. .
5,449,871 9/1995 Batteux et al. .
5,450,048 9/1995 Leger et al. .
5,451,729 9/1995 Onderka et al. .
5,457,295 10/1995 Tanibe et al. .
5,467,069 11/1995 Payet-Burin et al. .
5,469,121 11/1995 Payet-Burin .
5,475,558 12/1995 Barjonnet et al. .
5,477,016 12/1995 Baginski et al. .
5,479,143 12/1995 Payet-Burin .
5,483,212 1/1996 Lankuttis et al. .
5,485,343 1/1996 Santos et al. .
5,493,083 2/1996 Olivier .
5,504,284 4/1996 Lazareth et al. .
5,504,290 4/1996 Baginski et al. .
5,510,761 4/1996 Boder et al. .
5,512,720 4/1996 Coudert et al. .
5,515,018 5/1996 DiMarco et al. .
5,519,561 5/1996 Mrenna et al. .
5,534,674 7/1996 Steffens .
5,534,832 7/1996 Duchemin et al. .
5,534,835 7/1996 McColloch et al. .

| | | | |
|---|---|---|---|
| 5,534,840 | | 7/1996 | Cuingnet . |
| 5,539,168 | | 7/1996 | Linzenich . |
| 5,543,595 | | 8/1996 | Mader et al. . |
| 5,552,755 | | 9/1996 | Fello et al. . |
| 5,581,219 | | 12/1996 | Nozawa et al. . |
| 5,604,656 | | 2/1997 | Derrick et al. . |
| 5,608,367 | | 3/1997 | Zoller et al. . |
| 5,784,233 | | 7/1998 | Bastard et al. . |
| 5,960,941 | * | 10/1999 | Castonguay ..... 200/308 |

FOREIGN PATENT DOCUMENTS

| | | |
|---|---|---|
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 223 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

CIRCUIT BREAKER ACCESSORY GAP CONTROL MECHANISM

BACKGROUND OF THE INVENTION

This invention relates to circuit breaker accessories, and, more particularly to gap control mechanisms for circuit breaker accessories.

Circuit breakers commonly implement accessories to add various functionalities. These accessories may provide a mechanical force to an operating mechanism of a circuit breaker, for example, in response to a trip event that provides an electronic signal to interrupt the circuit (i.e., electronic trip actuators, shunt trip actuators, under voltage actuators, etc.).

Accessories typically include movable linkages and members that change position to perform a function upon occurrence of a trip event. For example, the accessory may include an actuating mechanism that acts on a link in response to a trip event, such as the overcurrent conditions detected from various circuitry. The link, when not acted upon, engages or holds a trip member against the bias of a spring. When the link is acted upon, it disengages or releases the trip member, whereby the bias of the spring acts on the trip member. The trip member then provides a mechanical force to a circuit interrupter. However, after use, the trip member must be reset to the original, ready to trip position. After resetting, it is desirable that the space between the actuating mechanism and the link is consistently maintained so the release of the trip member is properly effectuated.

Furthermore, it is desirable to provide an engagement that prevents the members from becoming disengaged from each other due to vibrations occurring under normal operating conditions (commonly referred to as "shock-out"). It is also important that the engagement be quickly and reliable releasable upon occurrence of a trip event so that the motion of the members, hence the force provided to the operating mechanism, is rapid and unhindered.

For the foregoing reasons, there exists a particular need for an arrangement between movable members that consistently provides the desired spacing between the members, securely maintains the engagement between the members, and allows for rapid disengagement of the members upon occurrence of an event, i.e., a trip event.

SUMMARY OF THE INVENTION

An accessory for use with a circuit breaker is provided herein. The accessory is employed within a circuit breaker that includes a separable contact structure and an operating mechanism for opening and closing the separable contact structure. The accessory has an electrical or actuating device with a movable component. The movable component interfaces with a first member, or link, such that the first member is in a first position or latched position when the movable component is not actuated, and is moved to a second position or tripped position when the movable component is actuated. The first member also engages a second member, or trip member, when the first member is in the latched position. The second member is configured to interface the operating mechanism when the engagement between the first member and the second member is released, i.e., when the first member is moved to its second position. The second member includes a seat portion that interfaces the first member, whereby the shape and configuration of the seat portion sets a gap between the movable component and the first member.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
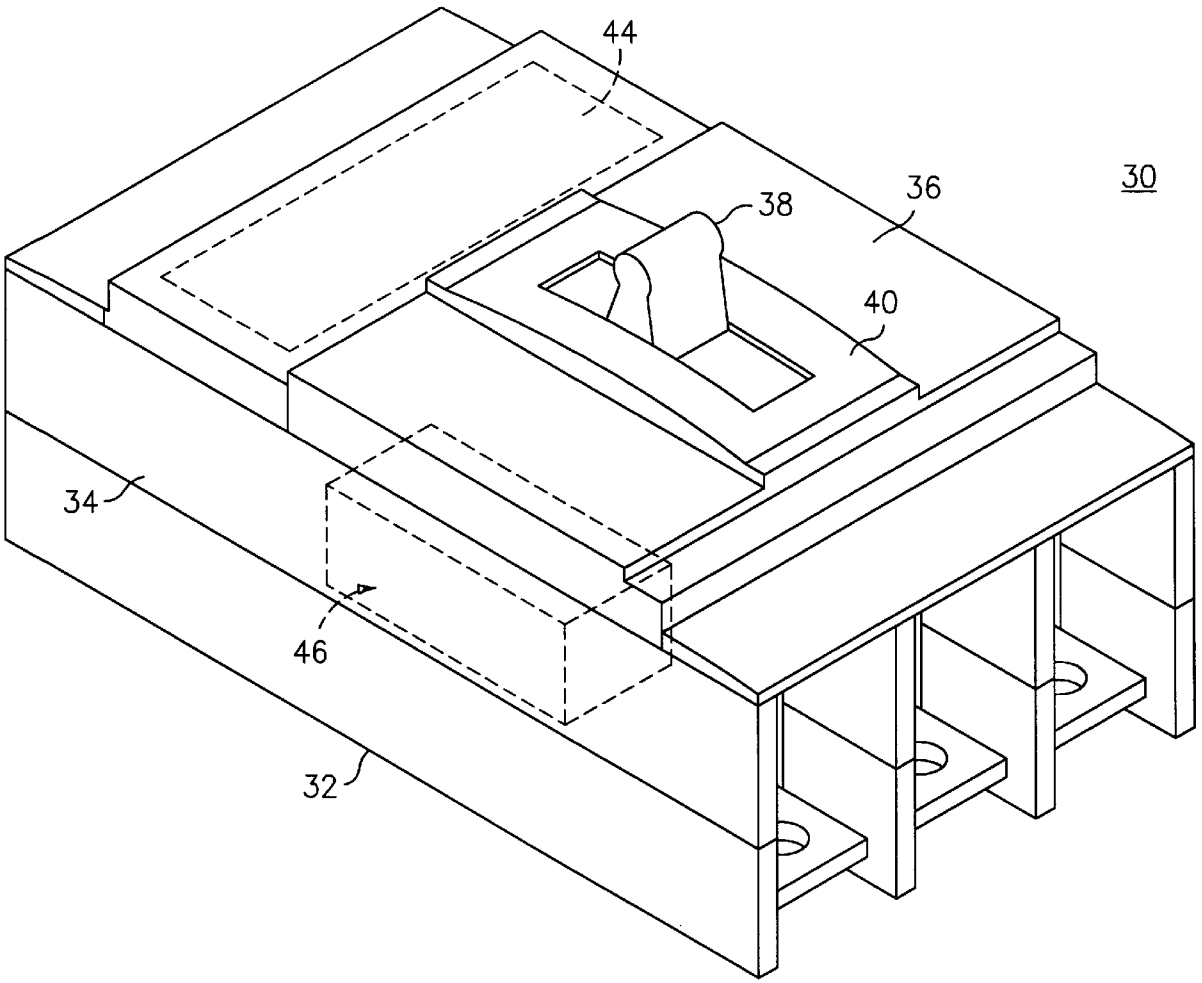
FIG. 1 is a top perspective view of a circuit breaker.
Figure 2:
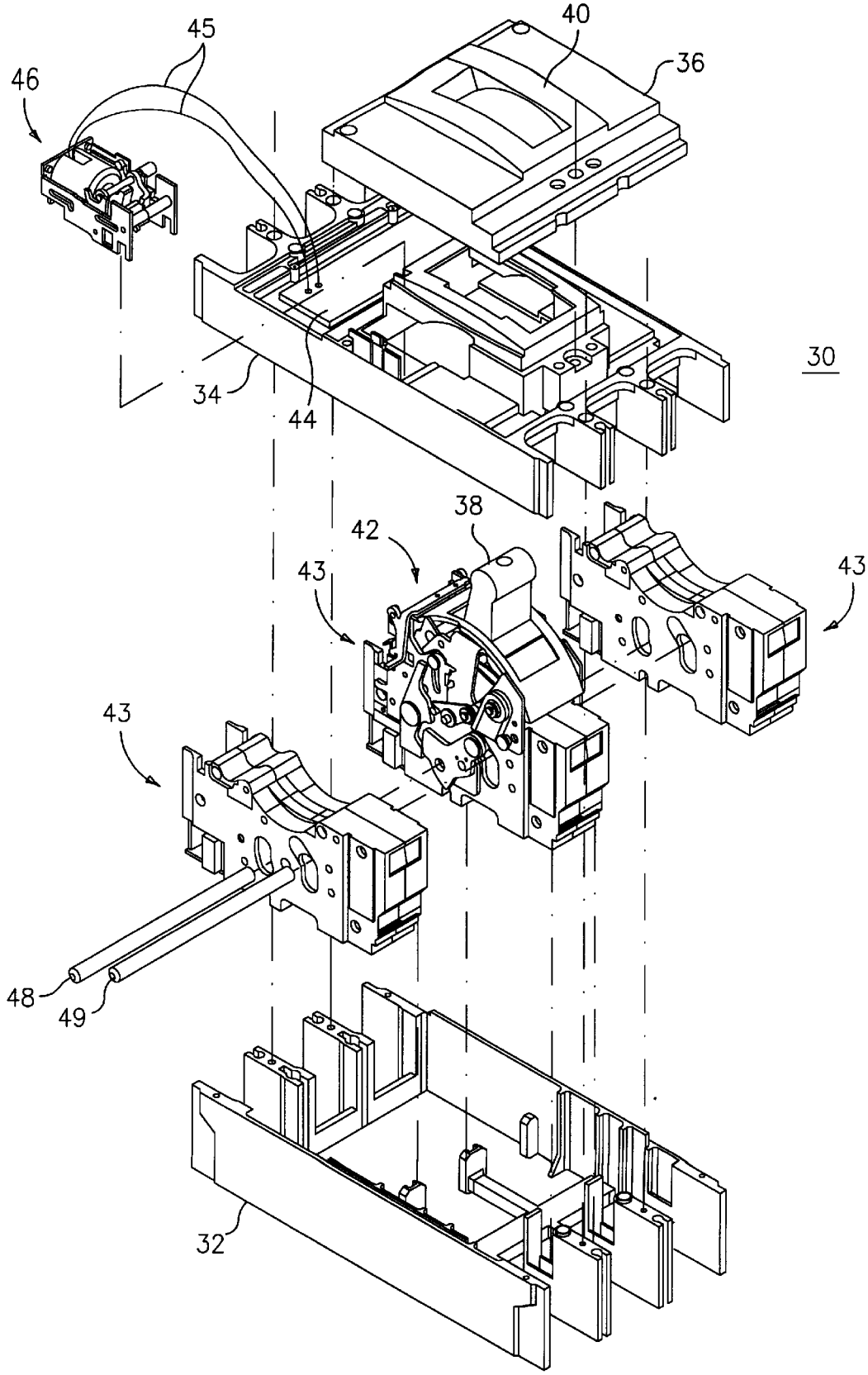
FIG. 2 is an exploded front perspective view of a circuit breaker.

In an exemplary embodiment of the instant application, a circuit breaker 30 is shown in FIGS. 1 and 2. Circuit breaker 30 includes a base 32, a mid cover 34 and an accessory cover 36 that assemble to enclose various circuit breaker components. Accessory cover 36 includes an operating handle 38 passing through an escutcheon 40. Operating mechanism 42 allows for resetting of a series of cassettes 43 by the motion of operating handle 38 against the bias of mechanism springs. Operating mechanism 42 additionally receives mechanical action from an accessory 46, which may be a device of the type including, but not limited to, electronic trip actuators, shunt trip actuators, under voltage actuators or bell alarms. Operating mechanism 42 is, for example, similar to that described in commonly owned and assigned U.S. application Ser. No. 09/196,706 (GE Docket Number 41PR-7540), entitled "Circuit Breaker Mechanism For A Rotary Contact System", and in U.S. application Ser. No. 09/xxx, xxx (GE Docket Number 41PR-7566), entitled "Circuit Breaker Handle Block".

Accessory 46 is positioned generally within mid cover 34 and is covered by accessory cover 36. In one exemplary embodiment, accessory 46 is coupled to a trip unit 44 via a set of wires 45 to receive an electronic signal causing mechanical action within accessory 46.

Cassettes 43 are, for example, of the rotary type and are positioned within base 32 and covered by mid cover 34. Each of cassettes 43 typically includes a set of contacts therein that remain closed by forces of powerful contact springs thereby allowing current to pass through (i.e., quiescent operation). The contacts open upon an overcurrent condition that generate magnetic forces that are strong enough to overcome the forces of the contact springs (i.e., "blow-open forces"), or, in response to a trip signal provided to operating mechanism 42 by accessory 46. The operation of cassettes 43 is described in more detail in, for example, in U.S. patent application Ser. Nos. 09/087,038 (GE Docket Number 41PR-7500) and 09/384,908 (GE Docket Number 41PR7613/7619), both entitled "Rotary Contact Assembly For High-Ampere Rated Circuit Breakers", and U.S. patent application Ser. No. 09/384,495, entitled "Supplemental Trip Unit For Rotary Circuit Interrupters".

Operating mechanism 42 is configured and positioned to interface with crossbars 48,49. Crossbars 48,49 interact with cassettes 43 and are configured to maintain the contacts of all cassettes 43 in a common position (i.e., open or closed) under control of operating mechanism 42. It is contemplated that the arrangement of cassettes 43 and operating mechanism 42 can vary depending on factors including, but not limited to, the number of phases of current, the type of circuit being protected, etc.

Figure 3:
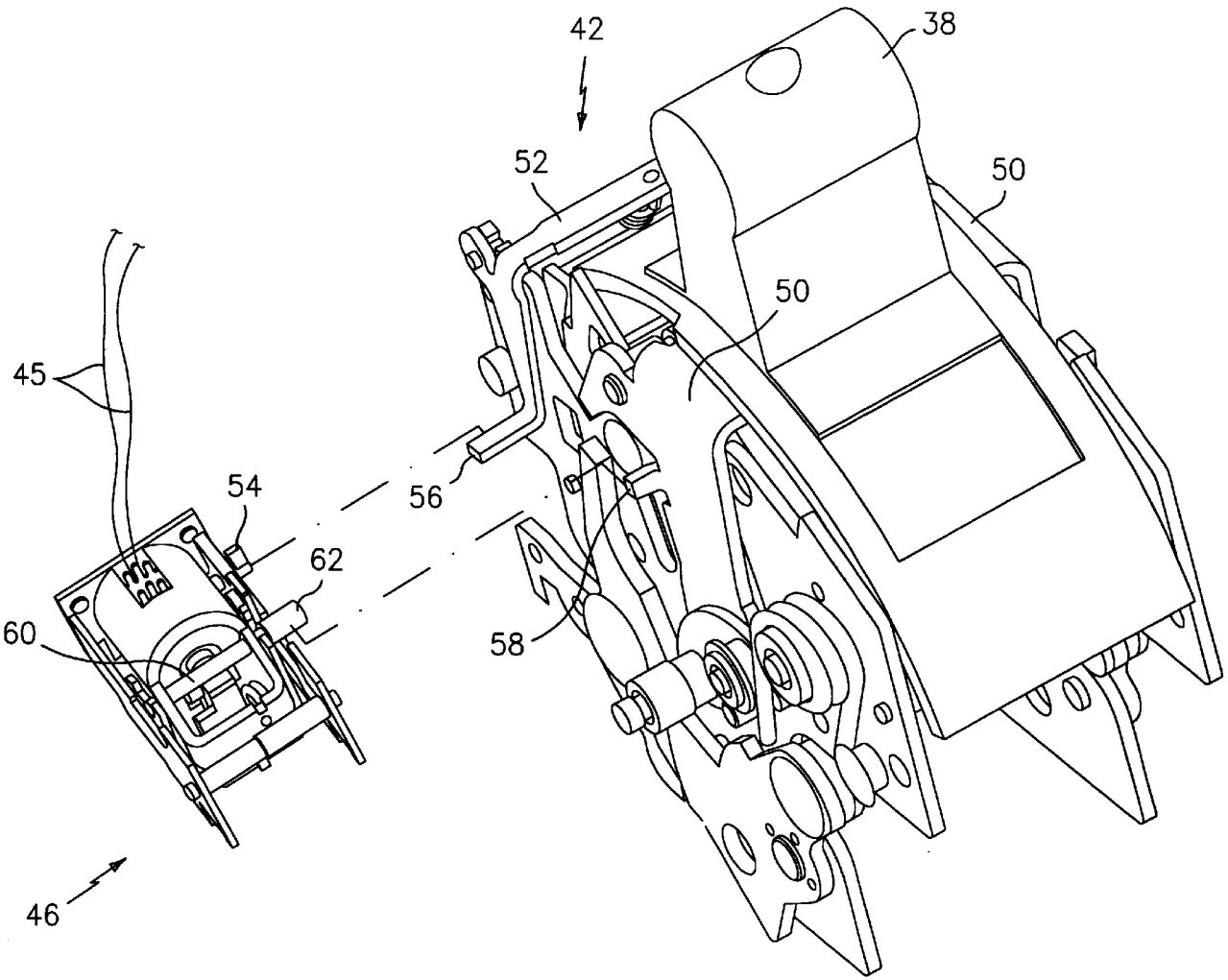
FIG. 3 is a side perspective view of an accessory and an operating mechanism arranged within the circuit breaker of FIGS. 1 and 2.

Referring now to FIG. 3, operating mechanism 42 and accessory 46 are depicted. Operating mechanism 42 generally includes, among other things, operating handle 38, a handle-yoke 50, a latch 52 and additional linkage to allow interaction between operating mechanism 42 and cassettes 43 via crossbars 48,49.

Operating mechanism 42 includes various linkage and mechanism springs to move the contacts within cassettes 43 in the desired position. The movement may be effectuated externally (i.e., by manually or mechanically urging operating handle 38). Furthermore, the movement may be triggered by accessory 46. When accessory 46 is actuated, a slide tab 54 will be displaced and transmit motion to a trip tab 56 of latch 52 (described further herein). Latch 52 is releasably coupled with another latch within operating mechanism 42 (not shown) against forces of one or more mechanism springs (not shown). When trip tab 56 is contacted by slide tab 54, latch 52 decouples from the other latch (not shown) within operating mechanism 42, thereby causing linkage to rotate crossbars 48,49 and open the contacts within cassettes 43.

To reset operating mechanism 42, handle 38 is urged (generally in the direction toward latch 52) until the mechanism springs of operating mechanism 42 are charged, i.e., ready to trip, and latch 52 is coupled within operating mechanism 42 to another latch (not shown). Handle-yoke 50 is interconnected with operating handle 38 and includes a reset tab 58 depending perpendicularly therefrom to allow interface with head 62 of a reset pin 60. Reset pin 60 is disposed within accessory 46, therefore, when operating mechanism 42 is reset by urging operating handle 38 (generally in the forward direction as shown in FIG. 3), reset tab 58 will accordingly transmit motion to head 62 and also reset accessory 46.

Turning now to FIGS. 3–7, various views of accessory 46 are provided. It is, of course, contemplated that the accessory described with reference to FIGS. 3–7 is provided as an exemplary embodiment only. Therefore, the releasable engagement embodied by the present invention may be employed in, for example, other types of accessories or in other mechanisms where the configuration requires one member being releasably engaged from another member and particularly where a space is to be maintained between members.

Accessory 46 comprises a frame 64 having an electrical device such as an actuator 66, a reset drive 70, a slide 74, and linkage including a plunger link 78 and a slide link 82. A pivot pin 86 is positioned through opening 79 in plunger link 78, openings 83 in slide link 82 and openings 71 in reset drive 70. Pivot pin 86 is a common rotation center for reset drive 70, plunger link 78, and slide link 82. Furthermore, reset drive 70 interfaces with plunger link 78 via a plunger reset spring 90, and reset drive 70 interfaces with slide link 82 via a slide reset spring 94. Plunger reset spring 90 and slide reset spring 94 are generally of the torsional type and are rotatably arranged on pivot pin 86 along with plunger link 78, slide link 82 and reset drive 70. A releasable engagement 122, described in further detail herein, is generally effectuated between plunger link 78 and slide 74.

Frame 64 includes sidewalls 98, a spacer pin 102 and a back wall 106. A trip member, configured as slide 74, includes slide tab 54 for providing a trip action to operating mechanism 42 (at trip tab 56). Slide 74 is slideably maintained by a pair of slide rivets 110 that are disposed within slots 114 upon one sidewall 98. A spring 118 is disposed around a portion of slide 74 having a first end that provides a force to slide 74 and a second end maintained against back wall 106. During quiescent operation, slide 74 is maintained against the bias of spring 118. It is, of course, contemplated that variations on the shape and configuration of slide 74 are possible depending on factors including but not limited to the shape of frame 64, the space available in the circuit breaker case, the arrangement of the operating mechanism latches, etc. Additionally, the force provided may be from a spring that pulls slide 74, rather than pushes slide 74 as shown with reference to the Figures herein. Furthermore, a second slide 74 may be arranged on the other sidewall 98. These variations and alternative arrangements for slide 74 and the force provided to slide 74 will be apparent to one skilled in the art.

Figure 5B:
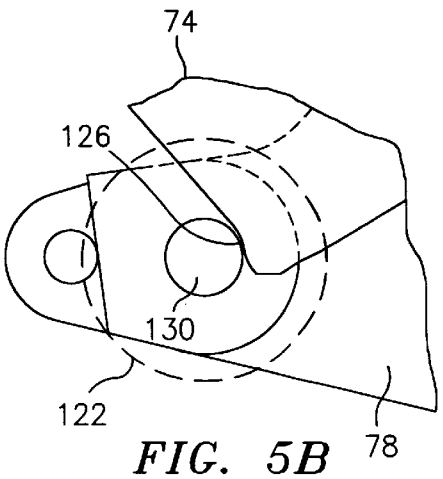
FIG. 5B is an exploded view of a releasable engagement.
Figure 5A:
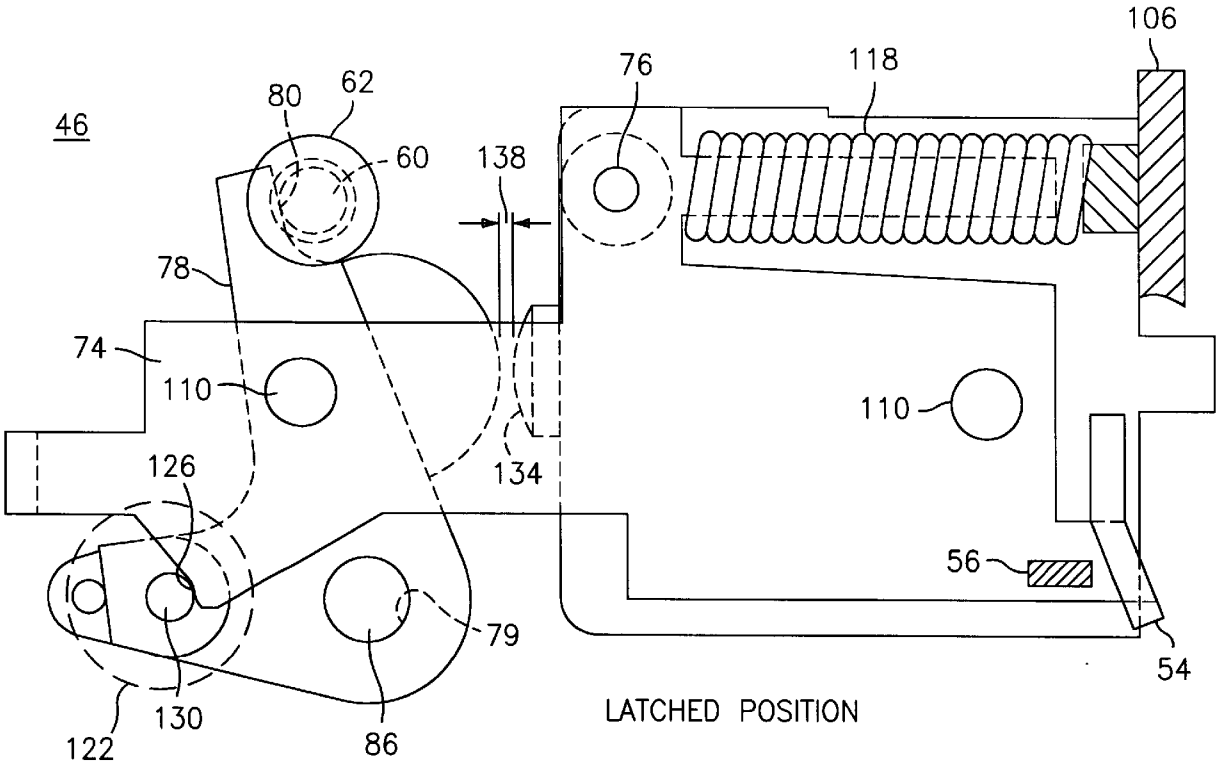
FIG. 5A is a side view of the accessory of FIG. 4 in the latched position.

Referring particularly now to FIGS. 5A an 5B, engagement 122 (shown in FIG. 5B by a partial enlarged view) is effectuated between a portion of slide 74 referred to as a seat 126 and a pin 130 depending from plunger link 78. Pin 130 is generally cylindrical in cross-sectional shape and protrudes from plunger link 78 a distance sufficient to engage seat 126 as described herein. Various arrangements of engagement 122, including the shape of seat 126, will be detailed further herein.

Actuator 66 includes a movable member, such as a plunger 134, that extends from actuator 66 in response to a signal provided upon the occurrence of a trip event or outside command through wires 45. Actuator 66 is any suitable type, including, but not limited to magnetic actuators, spring-biased actuators or other mechanical actuator that responds to an electrical signal (i.e., through wires 45). Plunger 134 moves from a retracted or unextended ("loaded") position during quiescent operation to a protruded or extended ("tripped") position in response to a trip event.

Plunger link 78 is positioned and configured upon pivot pin 86 such that a gap 138 exists between plunger link 78 and plunger 134 during quiescent operation. The selected configuration of engagement 122 determines the size of gap 138. When plunger 134 is moved to the protruded position, plunger link 78 is contacted. The contact causes plunger link 78 to rotate about pivot pin 86 (in the counter clockwise direction as oriented in the Figures) from a first position corresponding with quiescent operation (FIG. 5A), whereby pin 130 is latched with respect to seat 126 of slide 74, to a second position (FIG. 6), whereby pin 130 is released from seat 126.

Figure 6:
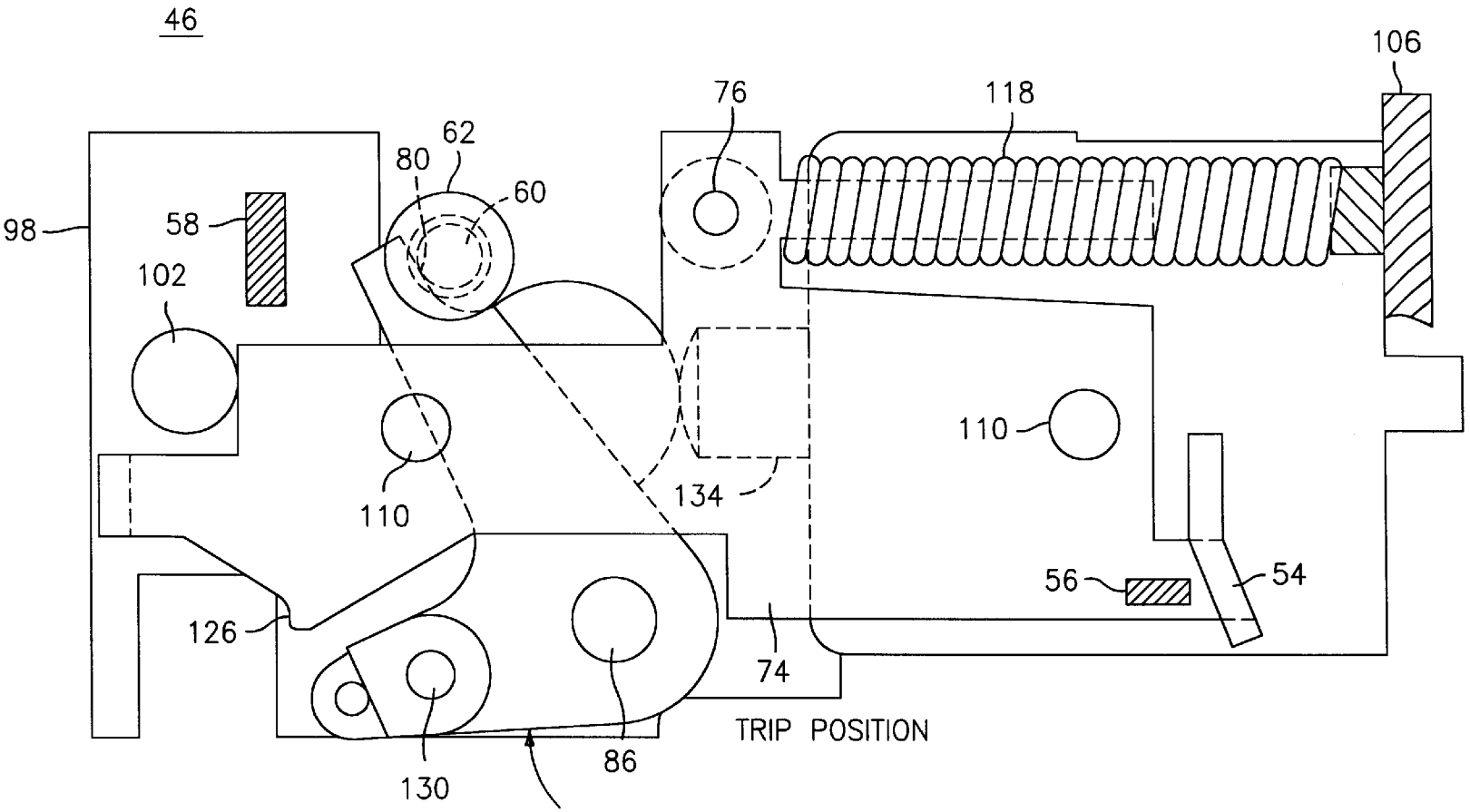
FIG. 6 is a side view of the accessory of FIG. 4 in the tripped position.

The release of engagement 122 allows spring 118 to extend and push slide 74. Slide 74 traverses generally to the left from the latched position in FIG. 5 to the trip position as viewed in FIG. 6. Slide 74 is generally guided by slide rivets 110 within slots 114 and traverses. Referring to FIGS. 3, 5A, and 6, this will cause slide tab 54 to contact trip tab 56, and slide 74 traverses until spacer pin 102 stops the movement of slide 74.

The rotation of plunger link 78 about pivot pin 86 in turn translates rotational motion to reset drive 70 via plunger reset spring 90. Reset drive 70 includes reset pin 60 having head 62 arranged through openings 72 generally positioned upon the sides of reset drive 70. Reset pin 60 is also disposed within C-shaped portions 84 of slide link 82. Furthermore, reset pin 60 is disposed against surface 80 of plunger link 78. Therefore, upon rotation of plunger link 78 due to contact from plunger 134, reset drive 70 will rotate and accordingly carry reset pin 60, causing plunger link 78 and slide link 82 to rotate about pivot pin 86.

Figure 4:
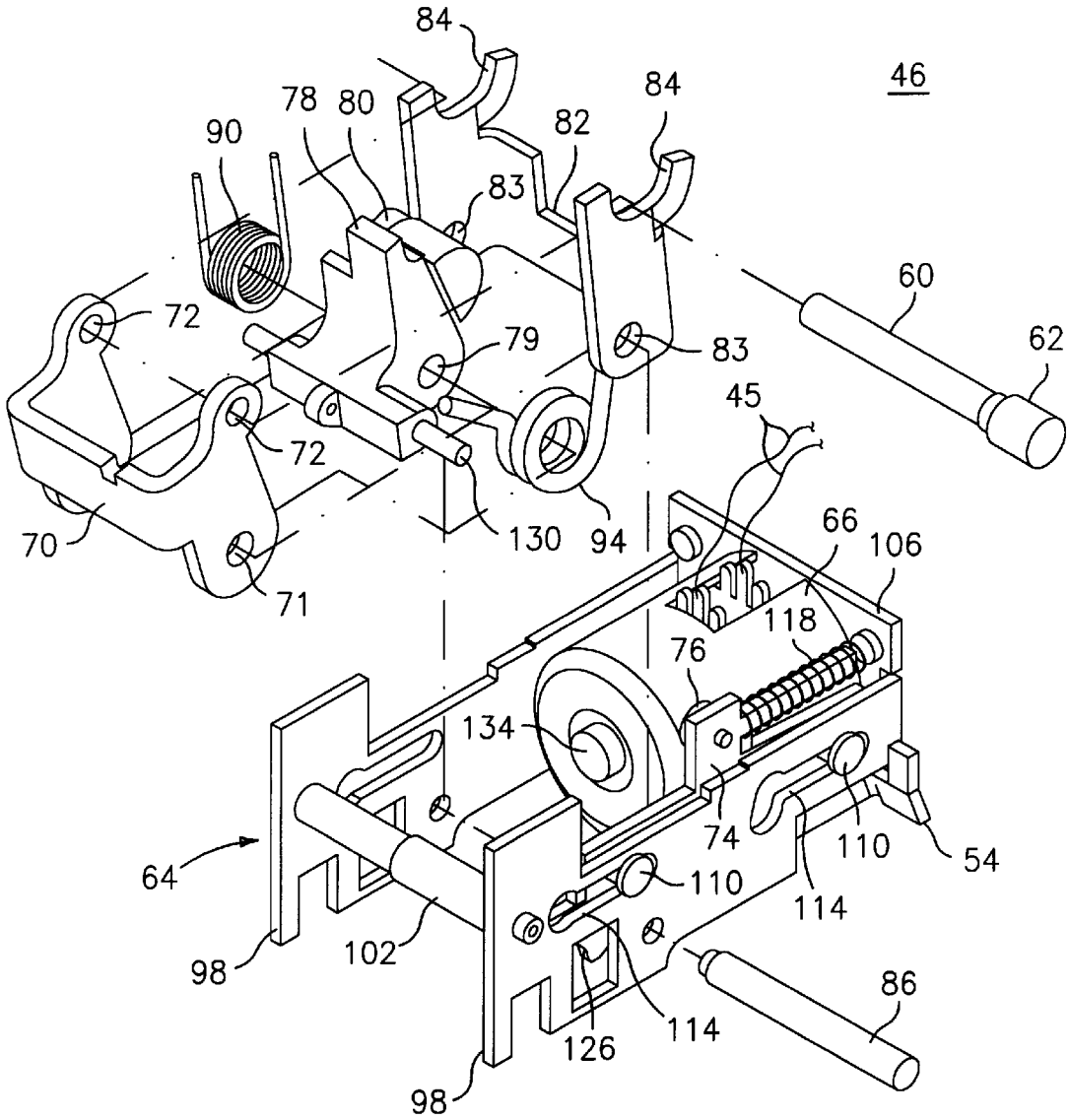
FIG. 4 is an exploded front perspective view of an accessory employing embodiments of the present invention.
Figure 7:
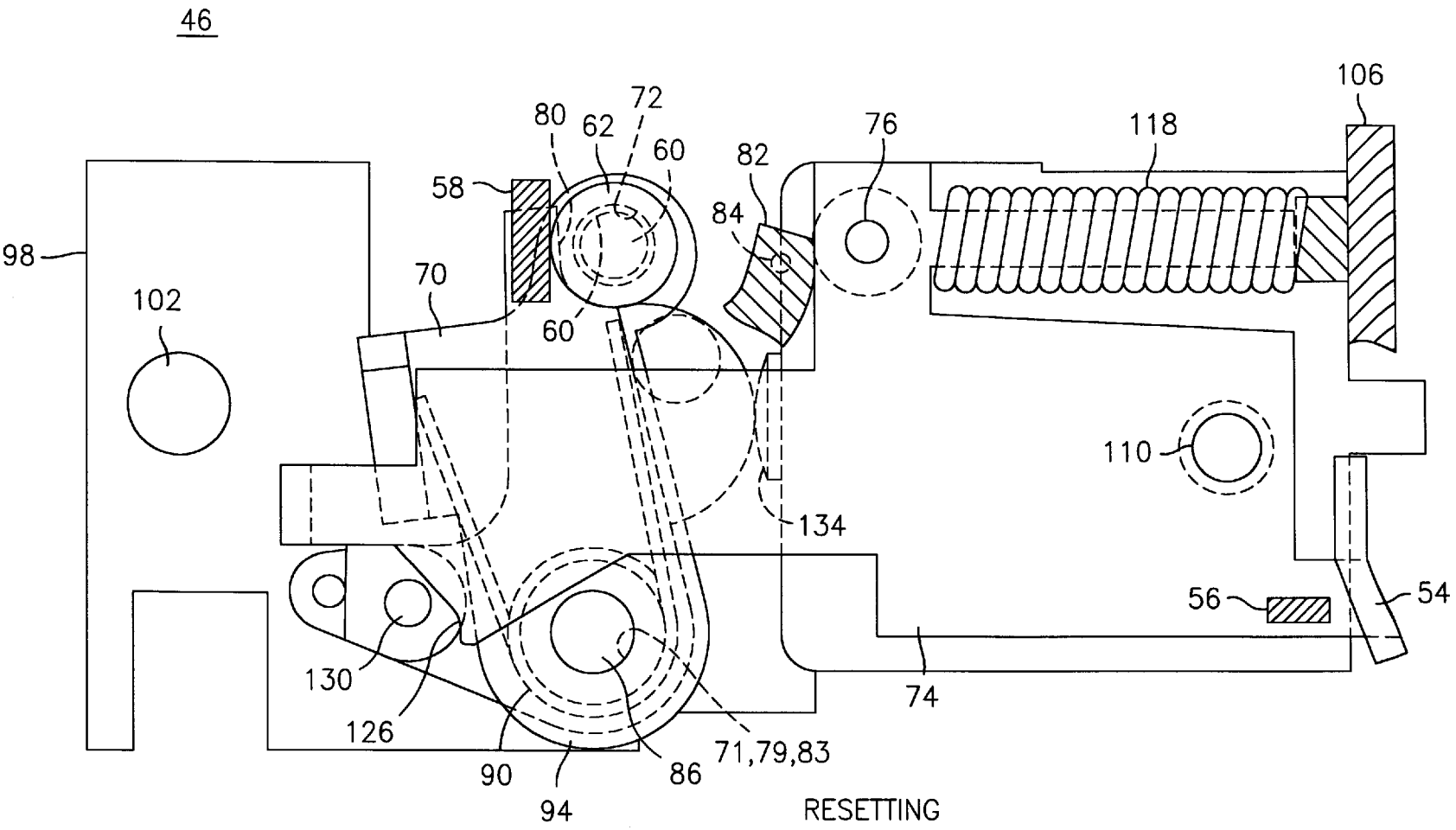
FIG. 7 is a side view of the accessory of FIG. 4 during resetting.

Referring to now to FIGS. 3, 4, and 7, the resetting of accessory 46 (and accordingly the reestablishment of engagement 122) will be described. Accessory 46 is reset when operating mechanism 42 is reset by the rotation of operating handle 38. Upon rotation of operating handle 38 to reset the system (i.e., operating mechanism 42, cassettes 43, accessory 46, etc.), reset tab 58 drives head 62 of reset pin 60. The motion of reset tab 58 translates through reset pin 60 to reset drive 70. Reset drive 70 rotates in the clockwise direction about pivot pin 86 and will accordingly transmit motion through slide reset spring 94 and plunger reset spring 90. The motion transmitted to slide reset spring 94 will drive slide link 82 in the clockwise direction about pivot pin 86, thereby urging the outside of C-shaped portion 84 against a rivet 76 arranged on slide 74. Slide 74 is displaced against spring 118. Additionally, the motion transmitted through plunger reset spring 90 will drive plunger link 78 in the clockwise direction about pivot pin 86, thereby driving plunger 134 into the retracted position. The rotation of plunger link 78 also causes pin 130 to align with seat 126. Therefore, when the reset force applied to operating handle 38 is removed, the system (i.e., accessory 46 and operating mechanism 42) is reset and engagement 122 is reestablished by the force of spring 118 driving slide 74 against pin 130.

Accessory 46 as described thus far includes the interface at plunger reset spring 90 between reset drive 70 and plunger link 78, and the interface at slide reset spring 94 between reset drive 70 and slide link 82. These interfaces add absorbency when reset motion is applied. Accessory 46 including these spring interfaces as outlined above is similar to the device described in a copending and commonly assigned application U.S. Ser. No. 09/467,209, General Electric Docket Number 41PR-7648, entitled "Circuit Breaker Accessory Reset System". It is contemplated that such an accessory is only one example of an accessory wherein engagement 122 and its variations described herein may be employed.

Figure 8:
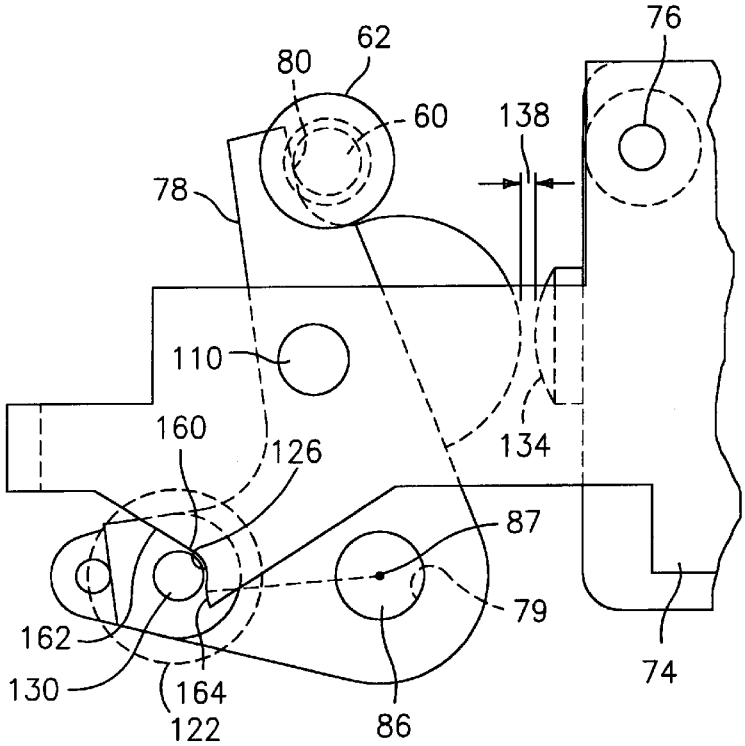
FIG. 8 is an enlarged side view of an embodiment of a releasable engagement employed within the accessory of FIGS. 3–7.
Figure 9:
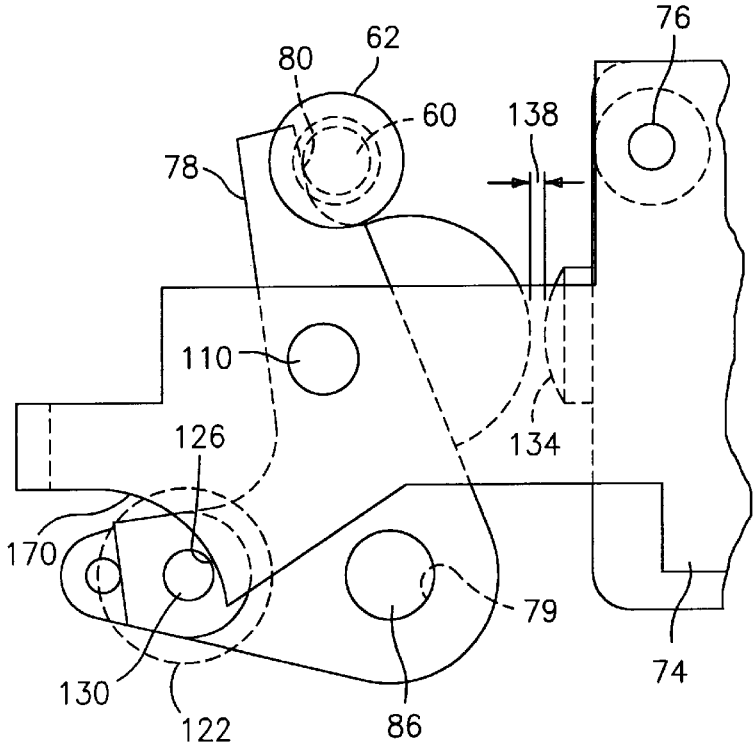
FIG. 9 is an enlarged side view of an alternative embodiment of a releasable engagement.

The shape and location of seat 126 determines the size of gap 138 between plunger 134 and plunger link 78. Additionally, the shape and position may provide resistance to inadvertent disengagement of seat 126 and pin 130. FIGS. 8 and 9 detail certain exemplary shapes of seat 126.

FIG. 8 is an enlarged view of slide 74 showing an exemplary configuration of engagement 122 and seat 126.

A consistently sized gap 138 is provided by engagement 122 including pin 130 holding slide 74 at seat 126. Seat 126 comprises a corner 160 defined at the juncture of a first surface 162 and a second surface 164. First surface 162 is generally a straight surface having a relatively shallow downward slope from left to right, and second surface 164 is an arcuate convex surface. In the latched condition, pin 130 is seated within corner 160 whereby pin 130 is in contact with first surface 162 and second surface 164.

The selected position of corner 160 influences the set or latched position for slide 74 and plunger link 78. For example, if first surface 162 were situated lower than is shown, or if the slope of first surface 162 were decreased (i.e., closer to horizontal), corner 160 would also be lower and the force of spring 118 would cause slide 74 to be positioned further to the left, and pin 130 would be seated further counter clockwise about pivot pin 86. This would cause gap 138 between plunger link 78 and plunger 134 in the retracted position to increase. Conversely, if first surface 162 were situated higher than is shown, or if the slope of first surface 162 were greater (i.e., closer to vertical), corner 160 would also be higher and pin 130 would be seated further clockwise than is shown, therefore decreasing gap 138. Additionally, the configuration and position of second surface 164 may be modified to change the size of gap 138. It is, of course, contemplated that the configurations and positions of first surface 162, second surface 164, or both first surface 162 and second surface 164 may be modified to vary gap 138 or to provide or attenuate other benefits as described below.

The required size of gap 138 can vary depending on the particular usage. Gap 138 may be increased or decreased based on reasons including, but not limited to, the quantity of force generated by plunger 134, the force required to decouple engagement 122, the frictional resistance at the interface of pin 130 and seat 126, and various system tolerances.

Other benefits are derived from the shape of seat 126 as provided in the embodiment of FIG. 8. This position resists shock-out or premature disengagement. In order for pin 130 to become disengaged from seat 126 (i.e., upon counter clockwise rotation of plunger link 78 about pivot 86), the distance of second surface 164 must be cleared before the bias of spring 118 can push pin 130 back into corner 160. The arcuate shape of second surface 164 requires a certain amount of force (i.e., from plunger 134) to move pin 130 past the apex of second surface 164. Furthermore, the downward slope of first surface 162 provides leeway in the event of an inadvertent clockwise rotation of plunger link 78 so that pin 130 does not "bounce" off of a rigid surface and cause plunger link 78 to rotate counter clockwise.

Once the apex is reached, pin 130 will tend to accelerate when plunger link 78 is rotated about pivot pin 86 in response to a strike from protruding plunger 134. This allows for a quick and smooth release when so desired. In an exemplary embodiment, the shape of arcuate second surface 164 is an arc having a radius at a center point 87 of pivot pin 86 (as indicated by dashed lines). In this configuration, the force required to release engagement 122 is primarily to overcome the friction between pin 130 and seat 126.

Referring now to FIG. 9, an alternate configuration for engagement 122 is provided. Seat 126 is defined by the inside of a single arcuate surface 170. Surface 170 is generally a concave arc configured to meet the required gap size. Furthermore, surface 170 may be configured to provide shock-out resistance. In this embodiment, the latched position, and hence gap 138, is determined by the geometry of arcuate surface 170, which dictates the position on surface 170 where pin 130 rests while slide 74 is pushed by spring 118.

Engagement 122 as detailed herein provides a variety of features and combination of features. These features include, but are not limited to, setting the size of gap 138, ensuring a rapid release between the first member (i.e., plunger link 78) and the second member or trip member (i.e., slide 74), and providing a reliable engagement between the first member in the second member that is resistant to, for example, external vibrations. These features may be varied by, for example, varying the configuration of the surface or surfaces. For example, surface 170 (FIG. 9) may be provided with a different radius. Alternatively, first and second surfaces 162 and 164 respectively (FIG. 8) may be provided with different sizes, shapes, and angles. For example, second surface 164 may be provided straight rather than arcuate. Furthermore, more than two surfaces may be provided to set gap 138, where pin 130 will rest within a pocket created by a plurality of surfaces.

It is contemplated that alternative accessory arrangements, i.e., other than that described above with reference to FIGS. 3–7, may utilize any of the various engagements 122 described above and claimed by the instant application. One such alternative accessory arrangement which may be employed within the circuit interrupter is provided in FIG. 10.

Figure 10:
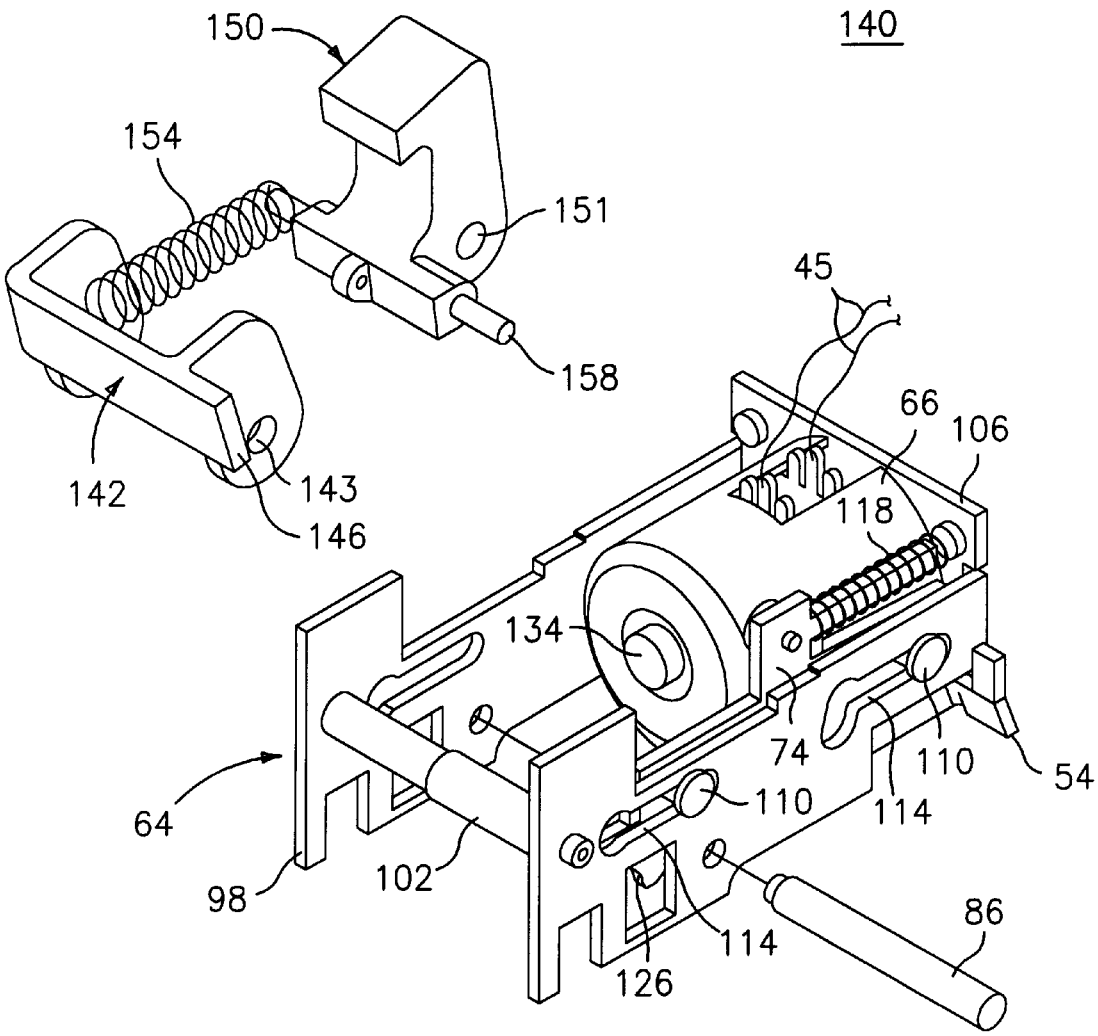
FIG. 10 is an exploded front perspective view of an alternative accessory employing embodiments of the present invention.

An accessory 140 as depicted in FIG. 10 includes a similar frame 64 (having sidewalls 98, spacer pin 102 and back wall 106), actuator 66 (having plunger 134) and slide 74 (having seat 126 and guided by slide rivets 110 within slots 114 of one sidewall 98). Accessory 140 further includes a monolithic reset drive 142 disposed on pivot pin 86 (at a set of openings 143), reset drive 142 including a reset tab interface 146. Reset tab interface 146 receives motion from reset tab 58 of operating mechanism 42 in a similar manner as described above with reference to FIG. 3–7 (i.e., the motion transmitted from reset tab 58 to head 62 of reset pin 60). Additionally, reset tab interface transmits 146 reset motion directly to slide 74

A linkage member 150 is also arranged on pivot pin 86 (at an opening 151) and is configured to link the action of plunger 134 with slide 74. Linkage member 150 is further configured to transmit reset motion from reset drive 142 to plunger 68 via a reset spring 154. Reset spring 154 may be arranged separately from reset drive 142 and linkage member 150, or reset spring 154 may be integral with either reset drive 142 (as shown in FIG. 18) or with linkage member 150 (not shown).

Linkage member 150 includes a pin 158 protruding therefrom for engaging slide 74 at seat 126 (i.e., engagement 122). In the latched position, engagement 122 maintains slide 74 against the force of spring 118, as described above with reference to FIGS. 3–7. When plunger 134 is caused to protrude, it contacts linkage member 150 thereby releasing engagement 122 and allowing slide 74 to traverse. As described above, when slide 74 traverses, motion is transferred to trip tab 56 of latch 52, thereby causing operating mechanism 42 to open the contacts of cassettes 43.

Other arrangements of accessory 46 (or accessory 140) that may utilize engagement 122 will be apparent to one skilled in the art. For instance, the movement of the various members may have different directions, or be effectuated by alternative means. For example, a second member (i.e., slide 74) may have a different type of biasing member (i.e., other than spring 118). The biasing member may be, for example, a leaf spring or torsional spring. In yet another alternative means for providing motion to the second member, a spring may be used to pull the second member (rather than push the second member as described above with reference to FIGS. 3–7).

Additionally, the type of motion may vary. While the above examples have been described with reference to a first member (i.e., plunger link 78) having rotational motion (i.e., about pivot pin 86) and a second member (i.e. slide 74) having linear motion (i.e., guided by slide rivets 110 disposed through slots 114), alternative arrangements having different motion relationships between the first and second members are contemplated.

For example, the first member may be configured for linear motion, i.e., in angular or vertical direction away from the second member, the second member being configured for horizontal linear motion as described above. The first member may be configured, for instance, by providing an interior guiding frame that allows the first member to traverse.

In another alternative, the first member may be configured for linear motion and the second member may be configured for rotational motion. The first member may be configured as described above, or may be configured for horizontal linear motion. The second member may be configured to rotate about a pivot, wherein the frame is shaped accordingly to allow, for example, a component simliar to slide tab 54 to contact trip tab 56.

While the invention has been described with reference to a preferred embodiment and various alternative embodiments, it will be understood by those skilled in the art that changes may be made and equivalents may be substituted for elements thereof without departing from the scope of invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An accessory for use with a circuit breaker, the circuit breaker including a separable contact structure, an operating mechanism for opening and closing the separable contact structure, the accessory comprising:

an electrical device having a movable component;

a first member, the first member interacting with the movable component for movement between a first position and a second position; and a second member, the second member including a first portion and a second portion, the first portion being configured to be engaged by a pin portion of the first member when the first member is in its first position and to be released by the pin portion of the first member when the first member is moved to its second position, and the second portion being configured to interface a portion of the operating mechanism, the release of the first portion of the second member by the pin portion of the first member causing the second portion of the second member to interface the portion of the operating mechanism.

2. An accessory as in claim 1, wherein the first member includes a pin that engages the seat portion.

3. An accessory as in claim 1, wherein the seat portion is shaped to define a gap between the movable component and the first member.

4. An accessory as in claim 3, wherein the seat portion includes a surface.

5. An accessory as in claim 4, wherein the surface is arcuate.

6. An accessory as in claim 5, wherein the surface is concave.

7. An accessory as in claim 3, wherein the seat portion includes a plurality of surfaces.

8. An accessory as in claim 7, wherein the plurality of surfaces includes a first surface and a second surface.

9. An accessory as in claim 8, wherein the movement of the first member between the first position and the second position is about a pivot, and further wherein the second surface is shaped as a convex arc.

10. An accessory as in claim 9, wherein the pivot has a center point, and further wherein the second surface has a radius having a center point at the center point of the pivot.

11. An accessory for use with a circuit breaker, the circuit breaker including a separable contact structure, an operating mechanism for opening and closing the separable contact structure, the accessory comprising:

an actuator having a movable plunger;

a plunger link, the plunger link having a portion being configured to be struck by the plunger for movement between a first position and a second position, and a pin portion; and a trip member, the trip member being configured to be engaged by the pin portion when the plunger link is in its first position and to be released by the pin portion when the plunger link is moved to its second position, the release by the pin portion causing the trip member to be displaced, the displacement of the trip member interfacing the operating mechanism to open the separable contact structure, the trip member being configured by including a seat portion that interfaces the pin portion, the seat portion being configured to set a gap between the plunger link and the plunger.

12. An accessory as in claim 11, wherein the seat portion is an arcuate surface.

13. An accessory as in claim 12, wherein the arcuate surface is concave.

14. An accessory as in claim 11, wherein the seat portion includes a plurality of surfaces.

15. An accessory as in claim 14, wherein the plurality of surfaces includes a first surface and a second surface.

16. An accessory as in claim 15, wherein the second surface is shaped as a convex arc.

17. An accessory as in claim 16, wherein the movement of the link between the first position and the second position is about a pivot having a center point, and further wherein the second surface has a radius having a center point at the center point of the pivot.

* * * * *

UNITED STATES PATENT AND TRADEMARK OFFICE

CERTIFICATE OF CORRECTION

PATENT NO. : 6,211,758 B1
DATED : April 3, 2001
INVENTOR(S) : Castonguay et al.

It is certified that error appears in the above-identified patent and that said Letters Patent is hereby corrected as shown below:

Column 8,
Line 54, before "to" delete "shaped" and insert therefor -- configured --

Signed and Sealed this

Fourth Day of January, 2005

JON W. DUDAS
*Director of the United States Patent and Trademark Office*